US006995733B2

(12) United States Patent
Waltho

(10) Patent No.: US 6,995,733 B2
(45) Date of Patent: Feb. 7, 2006

(54) FREQUENCY SELECTIVE SURFACE AND METHOD OF MANUFACTURE

(75) Inventor: Alan E. Waltho, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 249 days.

(21) Appl. No.: 10/328,479

(22) Filed: Dec. 24, 2002

(65) Prior Publication Data

US 2004/0119658 A1 Jun. 24, 2004

(51) Int. Cl.
*H01Q 15/02* (2006.01)

(52) U.S. Cl. ..... 343/909; 343/700 MS

(58) Field of Classification Search ..... 343/909, 343/700 MS, 846, 895, 756; H01Q 15/02
See application file for complete search history.

(56) References Cited

U.S. PATENT DOCUMENTS 5,543,809 A * 8/1996 Profera, Jr. ..... 343/753
5,579,024 A * 11/1996 Sureau ..... 343/909
6,262,495 B1 7/2001 Yablonovitch et al.
6,411,261 B1 6/2002 Lilly
6,483,481 B1 11/2002 Sievenpiper et al.
6,498,587 B1 * 12/2002 Desclos et al. ..... 343/700 MS
6,512,494 B1 1/2003 Diaz
2003/0076276 A1 * 4/2003 Church et al. ..... 343/909
2003/0231142 A1 * 12/2003 McKinzie et al. ..... 343/909

* cited by examiner

*Primary Examiner*—Hoanganh Le
(74) *Attorney, Agent, or Firm*—Tony M. Martinez

(57) ABSTRACT

Briefly, in accordance with an embodiment of the invention, a frequency selective surface (FSS) structure and a method is provided. The FSS structure may include a first conductive plate over a first surface of a substrate. The FSS structure may further include a first printed inductor over the first surface of the substrate and coupled to the first conductive plate. The method may include forming a frequency selective surface by patterning a first conductive material over a surface of a substrate to form a printed inductor.

26 Claims, 4 Drawing Sheets

100

FIG. 2
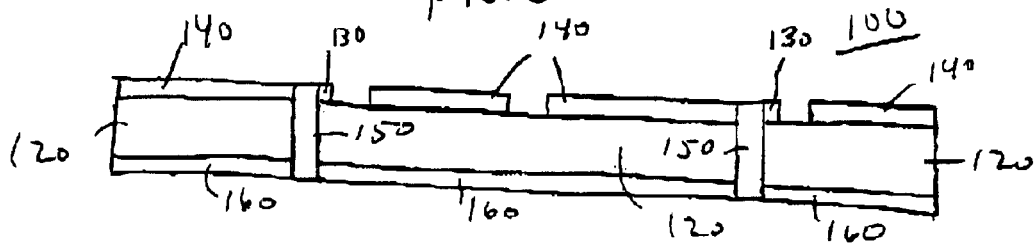
FIG. 3
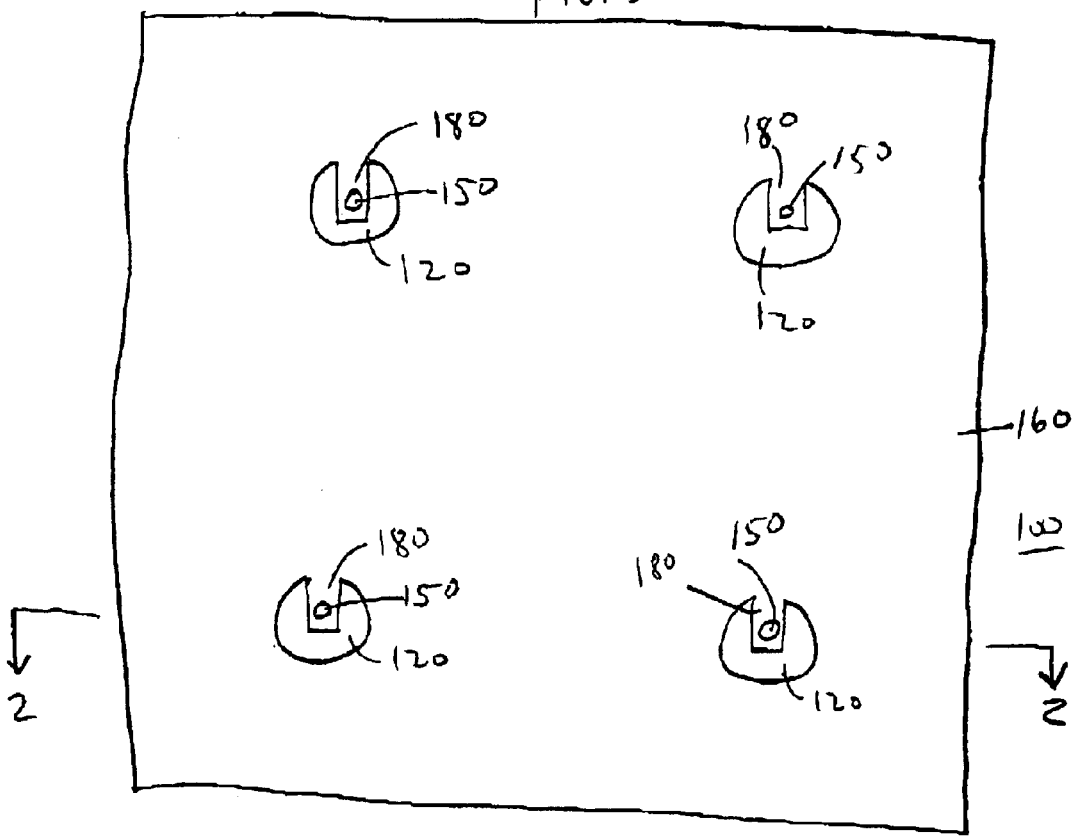
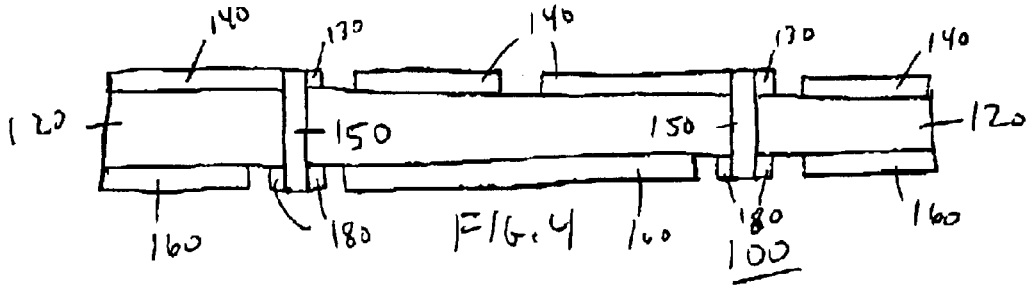
FIG. 4

300

FREQUENCY SELECTIVE SURFACE AND METHOD OF MANUFACTURE

BACKGROUND

Frequency selective surfaces (FSS) may be used to enable or facilitate the placement of antennas in wireless devices. In some applications, the use of a FSS may allow placement of antennas on or close to a ground plane of a wireless device. The FSS structure may suppress surface waves generated by energy radiated from an antenna. The FSS structure may also cause electromagnetic energy impinging on its surface to be reflected in-phase rather than anti-phase. Reflection of energy in-phase may allow an antenna to be placed directly on or in close proximity to the ground plane without it being shorted out.

The thickness of the structure may be altered in order to achieve a desired bandwidth and frequency. However, increasing the thickness may be undesirable since this may increase the size and weight of the FSS.

Thus, there is a continuing need for alternate FSS structures.

BRIEF DESCRIPTION OF THE DRAWINGS

The subject matter regarded as the invention is particularly pointed out and distinctly claimed in the concluding portion of the specification. The present invention, however, both as to organization and method of operation, together with objects, features, and advantages thereof, may best be understood by reference to the following detailed description when read with the accompanying drawings in which:

FIG. 2 is a cross-sectional view of the structure of FIG. 1 through line 1—1;

FIG. 3 is a bottom view illustrating a portion of a portion of a wireless structure in accordance with an embodiment of the present invention;

FIG. 4 is a cross-sectional view of the structure of FIG. 3 through line 2—2;

Figure 1:
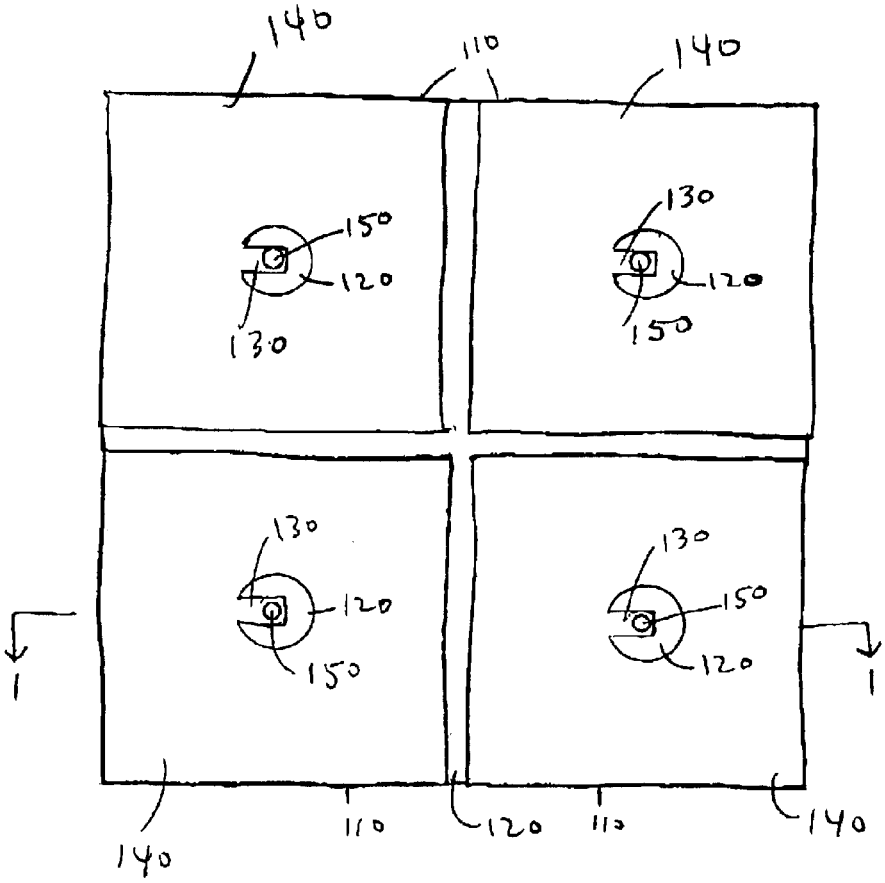
FIG. 1 is a top view illustrating a portion of a wireless structure in accordance with an embodiment of the present invention.

It will be appreciated that for simplicity and clarity of illustration, elements illustrated in the figures have not necessarily been drawn to scale. For example, the dimensions of some of the elements are exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the present invention. However, it will be understood by those skilled in the art that the present invention may be practiced without these specific details. In other instances, well-known methods, procedures, components and circuits have not been described in detail so as not to obscure the present invention.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

Similarly, the terms "over" and "overlying," may be used and are not intended as synonyms for each other. In particular embodiments, "overlying" may indicate that two or more elements are in direct physical contact with each other, with one on the other. "Over" may mean that two or more elements are in direct physical contact, or may also mean that one is above the other and that the two elements are not in direct contact.

The term "adjacent" may or may not imply contact and may be used to indicate an absence of anything of the same kind in between.

The following description may include terms, such as over, under, upper, lower, top, bottom, etc. that are used for descriptive purposes only and are not to be construed as limiting. The embodiments of an apparatus or article of the present invention described herein can be manufactured, used, or shipped in a number of positions and orientations.

FIG. 1 is a top view illustrating a portion of a wireless structure 100 in accordance with an embodiment of the present invention. Wireless structure 100 may include patterned conductive materials 110 over a top surface of a substrate 120, wherein each of the patterned conductive materials 110 include an inductor 130 and a conductive plate 140, wherein conductive plate 140 is connected to inductor 130. Conductive plate 140 may form one plate of a parallel plate capacitor.

FIG. 2 is a cross-sectional view of the structure illustrated in FIG. 1 through section line 1—1. Wireless structure 100 may further include vias 150 formed in substrate 120. In one embodiment, vias 150 are physically separated from each other and are formed extending between at least a top surface 121 and a bottom surface 122 of substrate 120. Wireless structure 100 may further include an electrically conductive plate 160 overlying surface 122 of substrate 120.

In one embodiment, substrate 120 may be a dielectric substrate. Although the scope of the present invention is not limited in this respect, substrate 120 may be any material suitable for a printed circuit board substrate such as a fiber reinforced polymer or a copper laminate epoxy glass (e.g., FR4).

Wireless structure 100 may be formed by forming a layer of a conductive material such as, for example, copper, overlying surface 122 of substrate 120 to form conductive plate 160. An adhesive may be used to bond conductive plate 160 to surface 122. Similarly, a layer of conductive material such as, for example, copper, may be formed overlying and adhesively bonded to surface 121 of substrate 120. This conductive layer on surface 121 may be a single layer or multiple layer of conductive material and may be patterned using, for example, an etch process, to form inductors 130 and conductive plates 140.

In one embodiment, after patterning the conductive layer on surface 121, holes (not shown) may be formed in substrate 120. These holes may be filled or plated with an electrically conductive material such as, for example, copper, to form conductive vias 150. Vias 150 may be formed at least between surfaces 121 and 122 of substrate 120, and may be formed so that one end of a via 150 is planar with an exposed surface of inductor 130 and so that the other end of via 150 is planar with an exposed surface of conductive plate 160. Vias 150 may also be formed at the geometric centers of conductive plates 140 or may be formed off-center. In one embodiment, via 150 may have a length approximately equal to the thickness of substrate 120 and a diameter of about 10 mils (about 0.25 mm).

Although the scope of the present invention is not limited in this respect, the thickness of structure 100 may be less than about 120 mils (about three milli-meters). In one embodiment, the thickness of structure 100 may be about 62 mils (about 1.57 mm), and in another embodiment, the thickness of structure 100 may be about 31 mils (about 0.78 mm) or any other standard thickness of printed circuit material.

In one embodiment, the thickness of conductive plate 160 may be less than about 2.4 mils (about 0.06 mm), the thickness of conductive plate 140 and inductor 130 may both be less than about 2.4 mils (about 0.06 mm), the thickness of substrate 120 may be less than about 62 mils (about 1.57 mm), and the length of via 150 may be less than about 62 mils (about 1.57 mm). In one embodiment, the length of inductors 130 may be at least as long as that of vias 150.

Conductive plate 160 may serve as a conductive ground plane. A capacitive element or capacitor may be formed using conductive plates 140 and 160. For example, conductive plate 140 may form the upper plate of a capacitor and conductive plate 160 may form the lower plate of the capacitor. As may be appreciated, at least four capacitors are illustrated in wireless structure 100 illustrated in FIGS. 1 and 2, wherein conductive plate 160 serves as a common lower plate of these four capacitors. These capacitors may be referred to as printed capacitors since their upper and lower plates may be formed by patterning a conductive material.

Conductive plates 140 may also be referred to as conductive patches or capacitive patches. In the embodiment illustrated in FIG. 1, conductive plates 140 may be substantially square-shaped, although the scope of the present invention is not limited in this respect. In other embodiments, conducive plates 140 may be rectangular, triangular, hexagonal, circular or irregularly shaped.

Inductors 130 formed overlying surface 121 may be referred to as printed inductors, inductive strips, or strip inductors. Inductor 130 may be formed between conductive plate 140 and conductive via 150. In addition, inductor 130 and via 150 may be formed so that a portion of inductor 130 surrounds an upper end of via 150, although the scope of the present invention is not limited in this respect.

In the embodiment illustrated in FIG. 1, inductors 130 may be formed by patterning a single layer of conductive material and may be substantially rectangular-shaped, straight conductors having no turns, although the scope of the present invention is not limited in this respect. In other embodiments, inductor 130 may be a coil having at least a partial turn, e.g., one turn, or have a spiral shape as is shown in the embodiment illustrated in FIG. 5. Altering the shape and length of inductor 130 may alter the inductance of inductor 130.

Wireless structure 100 may be used as a frequency selective surface (FSS) structure and coupled or in close proximity to an antenna or multiple antennas. In this example, structure 100 may have an equivalent circuit of multiple coupled resonant circuits formed from inductors 140, vias 150, and conductive plates 140 and 160. Each resonant circuit may include an inductive element and a capacitive element, wherein the inductive element includes inductor 130 and conductive via 150. The capacitive element may include conductive plates 140 and 160.

The resonance or resonant frequency may be the frequency where the reflection phase passes through zero. At this frequency, a finite electric field may be supported at the surface of conductive plate 160, and an antenna or multiple antennas may be placed adjacent to the surface without being shorted out. The bandwidth of structure 100, i.e., the operating bandwidth of an antenna coupled to structure 100, may be altered by adjusting the inductance: capacitance (L:C) ratio of the resonant circuits. For example, the bandwidth may be increased by increasing the inductance and decreasing the capacitance. In one embodiment, structure 100 may be used in devices operating at bandwidth frequencies of greater than 10% of the resonant frequency.

The bandwidth of structure 100 may be increased by altering the inductance of the inductive elements. In the embodiment illustrated in FIGS. 1 and 2, inductors 130 are serially connected to via 150, and therefore, the length of vias 150 and/or the length of inductors 130 may be increased to increase the inductance of the resonant circuits, thereby increasing the bandwidth. In some embodiments, the length of via 150 may be a predetermined fixed length, e.g., about 62 mils (about 1.57 mm), and the length of inductor 130 may be altered in order to alter the inductance and achieve a desired bandwidth. In this embodiment, the frequency of structure 100 may also be lowered by using printed inductors to increase the value of the inductive component of the resonant circuit. Other methods for altering the frequency of structure 100 may include altering the size of conductive plates 140 and/or altering the position of vias 150 relative to the center of capacitive plates 140. Wireless structure 100 may also be referred to as a photonic band gap structure or an artificial magnetic conductor.

Turning to FIGS. 3 and 4, another embodiment of wireless structure 100 is illustrated. FIG. 3 illustrates a bottom view of structure 100 and FIG. 4 illustrates a cross-sectional view of structure 100 through section line 2—2. In this embodiment, printed inductors 180 may be formed overlying bottom surface 122 of substrate 120.

In this embodiment, inductors 180 may be connected between via 150 and conductive plate 160. Inductors 180 and conductive plate 160 may be formed by pattering a single layer of conductive material using, for example, an etch process. In this embodiment, vias 150 and inductors 130 and 180 form the inductive elements of the resonant circuits of structure 100. As may be appreciated, the inductance of the inductive element may be altered by including inductors 180 and altering the length of inductors 180.

Inductors 180 may be formed at substantially right angles (about 90 degrees) relative to inductors 130. By forming inductors 130 and 180 at right angles to each other, the fields due to the inductors may not cancel each other.

Figure 5:
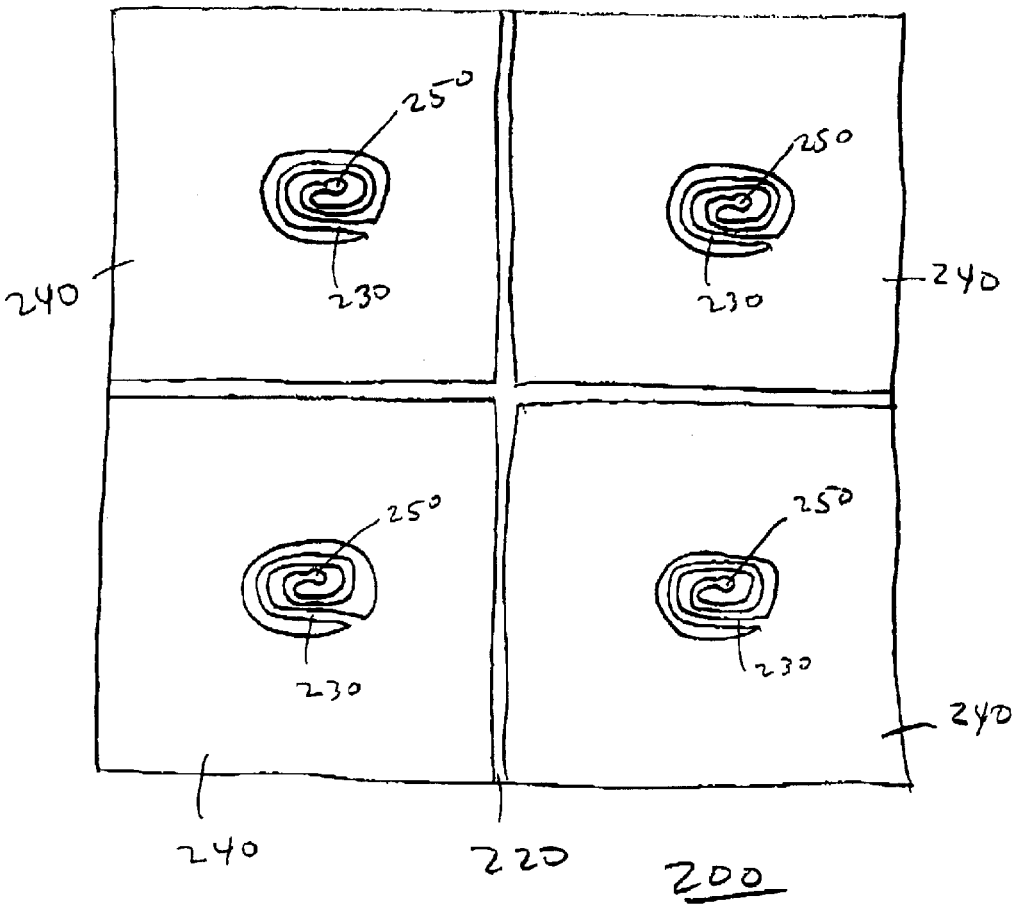
FIG. 5 is a top view illustrating a portion of a wireless structure in accordance with an embodiment of the present invention.

Turning to FIG. 5, a top view of another wireless structure 200, in accordance with another embodiment is illustrated. Wireless structure 200 may include a conductive plates 240 overlying a substrate 220. Wireless structure 200 may further include conducive vias 250 and inductors 230, wherein an inductor 230 may be connected between a via 250 and a conductive plate 240. Vias 250 may be formed in substrate 220 and may extend to a bottom surface (not shown) of substrate 220. Wireless structure 200 may further include a ground plane (not shown) overlying the bottom surface of substrate 220.

In this embodiment, substrate 220, inductors 230, conductive plates 240, and vias 250 may be composed of the same or similar materials as substrate 120, inductors 130, conductive plates 140, and vias 150, respectively. A single layer of conductive material may be patterned using, for example, an etch process, to form inductors 230 and conductive plates 240. In the embodiment illustrated in FIG. 5, inductors 230 may be spiral-shaped.

Wireless structure 200 may also be used as a FSS and coupled to an antenna, wherein the antenna may be placed flat on the ground plane (not shown) of structure 200. Wireless structure 200 may have an equivalent circuit of multiple coupled resonant circuits formed from inductors 240, vias 250, conductive plates 240 and a ground plane (not shown in FIG. 5). Each resonant circuit may include an inductive element and a capacitive element, wherein the inductive element is formed by inductor 230 and via 250. The capacitive element may be formed by conductive plates 140 and the ground plane.

Figure 6:
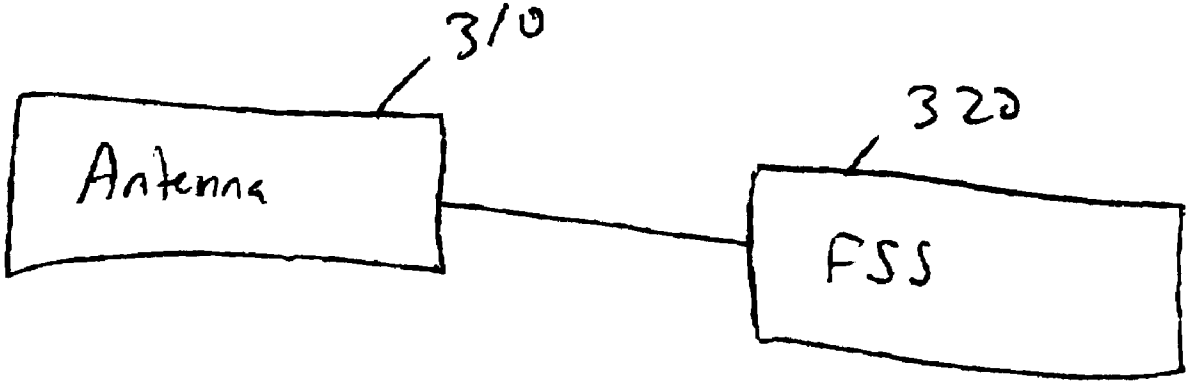
FIG. 6 is block diagram illustrating a portion of a wireless device in accordance with an embodiment of the present invention.

Turning to FIG. 6, a portion of a wireless device 300 in accordance with an embodiment of the present invention is described. Device 300 may be a personal digital assistant (PDA), a laptop or portable computer with wireless capability, a web tablet, a wireless telephone, a pager, an instant messaging device, a digital music player, a digital camera, or other devices that may be adapted to transmit and/or receive information wirelessly. Device 300 may be used in any of the following wireless systems: a wireless local area network (WLAN) system, a wireless personal area network (WPAN) system, a wireless wide area network (WWAN), or a cellular network, although the scope of the present invention is not limited in this respect.

Device 300 may include an antenna 310 coupled to FSS 320. It should be noted that other components may be included in device 300, such as wireless transceiver and/or input/output (I/O) circuitry, however, to provide clarity, these elements have been omitted from FIG. 6 and the absence of these elements is not a limitation of the scope of the present invention. FSS 320 may be a wireless structure such as, for example, wireless structures 100 and 200 discussed herein. Antenna 310 may be a dipole antenna or a monopole antenna, although the scope of the present invention is not limited in this respect. In one embodiment, antenna 310 may be adapted to communicate over a WLAN such as, for example, an IEEE 802.11 network. In other embodiments, antenna 310 may be adapted to communicate over a WPAN, WWAN, or cellular network.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. An apparatus, comprising:

a frequency selective surface (FSS) structure that includes:

a first conductive plate over a first surface of a substrate; and a first printed inductor over the first surface of the substrate and coupled to the first conductive plate;

a ground plane over a second surface of the substrate;

a first conductive via in the substrate and coupled to the ground plane and the first printed inductor; and a second printed inductor over the second surface of the substrate.

2. The apparatus of claim 1, wherein the ground plane, the first conductive plate, the first printed inductor, the second printed inductor, and the first conductive via form a resonant circuit.

3. The apparatus of claim 2, wherein the first conductive via is serially coupled to the printed inductor to form an inductive element.

4. The apparatus of claim 2, wherein the first conductive plate and the ground plane form a capacitive element, and wherein the first conductive plate forms an upper plate of the capacitive element and the ground plane forms a lower plate of the capacitive element.

5. The apparatus of claim 1, wherein the first printed inductor is coupled between the first conductive plate and the first conductive via.

6. The apparatus of claim 1, wherein the first printed inductor is a substantially rectangular-shaped conductor having a length at least as long as that of the first conductive via.

7. The apparatus of claim 1, wherein the length of the first conductive via is less than about 62 mils (about 1.57 mm) and wherein the length of the first printed inductor is greater than about 62 mils (about 1.57 mm).

8. The apparatus of claim 1, wherein the second printed inductor is coupled between the first conductive via and the ground plane and wherein the second printed inductor is formed at a substantially right angle relative to the first printed inductor.

9. The apparatus of claim 1, wherein the FSS structure further includes:

a second conductive plate over the first surface of the substrate and separate from the first conductive plate;

a third printed inductor over the first surface of the substrate and coupled to the second conductive plate; and a second conductive via in the substrate and coupled to the ground plane and the third printed inductor.

10. The apparatus of claim 1, wherein the first conductive plate is substantially square-shaped.

11. The apparatus of claim 1, wherein the first printed inductor has a spiral shape.

12. The apparatus of claim 1, wherein the first printed inductor is a coil having at least one turn.

13. The apparatus of claim 1, further comprising an antenna adjacent to the FSS structure.

14. The apparatus of claim 1, wherein the first printed inductor and the first conductive plate are formed by patterning a single layer of conductive material.

15. An apparatus, comprising:

a first conductive plate on a first surface of a substrate;

a first printed inductor on the first surface of the substrate and coupled to the first conductive plate;

a second conductive plate on a second surface of the substrate; and a conductive via between the first and second surfaces of the substrate and coupled to the first printed inductor and the second conductive plate; and a second printed inductor on the second surface of the substrate and coupled to the conductive via.

16. The apparatus of claim 15, wherein the first printed inductor and the first conductive plate are formed by patterning a single layer of conductive material.

17. An artificial magnetic conductor comprising:

a substrate;

a first patterned conductive material over a first surface of the substrate, wherein the first patterned conductive material includes a first inductive element and a first plate of a first capacitive element coupled to the first inductive element;

an electrically conductive material over a second surface of the substrate, wherein the electrically conductive material forms a second plate of the first capacitive element and includes a substantially rectangular-shaped conductor; and a first conductive via between the first and second surfaces of the substrate and coupled to the first inductive element and the substantially rectangular-shaped conductor, wherein a length of the substantially rectangular-shaped conductor is at least as long as a length of the first conductive via.

18. The artificial magnetic conductor of claim 17, wherein the substrate is a dielectric substrate and wherein the electrically conductive material forms a ground plane of the artificial magnetic conductor.

19. The artificial magnetic conductor of claim 17, further comprising:

a second conductive via between the first and second surfaces of the substrate;

a second patterned conductive material over the first surface of the substrate;

wherein the second patterned conductive material includes a second inductive element and a first plate of a second capacitive element coupled to the second inductive element;

wherein the second inductive element is coupled between the second via and the first plate of the second capacitive element; and wherein the electrically conductive material forms the second plate of the second capacitive element.

20. A system, comprising:

an antenna to communicate over a wireless local area network (WLAN); and a frequency selective surface (FSS) structure coupled to the antenna, wherein the FSS includes:

a first conductive plate over a first surface of a substrate; and a first printed inductor over the first surface of the substrate and coupled to the first conductive plate;

a ground plane over a second surface of the substrate;

a first conductive via in the substrate and coupled to the ground plane and the first printed inductor; and a second printed inductor over the second surface of the substrate.

21. The apparatus of claim 20, wherein the second printed inductor is formed at a substantially right angle relative to the first printed inductor.

22. The system of claim 20, wherein the ground plane, the first conductive plate, the first printed inductor, the second printed inductor, and the first conductive via form a resonant circuit.

23. The system of claim 20, wherein the second printed inductor is coupled between the first conductive via and the ground plane and wherein the second printed inductor is formed at a substantially right angle relative to the first printed inductor.

24. A method, comprising:

forming a first substantially rectangular-shaped conductor as a first printed inductor over a first surface of a dielectric substrate;

patterning a ground plane over a second surface of the dielectric substrate of an artificial magnetic conductor to alter inductance of the artificial magnetic conductor;

forming a conductive via through the dielectric substrate; and patterning a conductive material on a second surface of the artificial magnetic conductor to form a second printed inductor that is coupled to the conductive via, wherein the first substantially rectangular-shaped conductor is formed at a substantially right angle relative to the second substantially rectangular-shaped conductor and wherein a length of the first substantially rectangular-shaped conductor is at least as long a length of the conductive via.

25. The method of claim 24, wherein patterning the ground plane on a first surface of the artificial magnetic conductor to increase inductance of the artificial magnetic conductor by forming a first printed inductor on the first surface of the artificial magnetic conductor.

26. The method of claim 24, wherein patterning includes patterning the ground plane on a first surface of the artificial magnetic conductor to increase inductance of the artificial magnetic conductor by forming a first substantially rectangular-shaped conductor on the first surface of the artificial magnetic conductor.

* * * * *